United States Patent [19]

Danielsen et al.

[11] Patent Number: 4,555,133

[45] Date of Patent: Nov. 26, 1985

[54] CONTAINER RESTRAINT RELEASE

[75] Inventors: Donald P. Danielsen, Long Beach; Lewell M. Lively, Jr., Anaheim, both of Calif.

[73] Assignee: McDonnell Douglas Corporation, Long Beach, Calif.

[21] Appl. No.: 565,640

[22] Filed: Dec. 27, 1983

[51] Int. Cl.[4] ..... B66C 1/38

[52] U.S. Cl. ..... 294/82.24

[58] Field of Search ..... 294/83 R, 83 A, 84, 294/82 R, 66, 104; 24/241 P, 230 AP; 244/137 R, 151 B; 89/1.56

[56] References Cited

U.S. PATENT DOCUMENTS 3,493,260 2/1970 Smith ..... 294/83 R 4,179,150 12/1979 Conrad et al. ..... 294/83 R

*Primary Examiner*—James B. Marbert

*Attorney, Agent, or Firm*—Paul T. Loef; George W. Finch; Donald L. Royer

[57] ABSTRACT

A release/restraint mechanism for air-dropped cargo interposed between fixed aircraft structure and the restraining webbing. A fixed arm is oriented opposite a pivoted arm which is fixed in one position and free to rotate in the release position. A restraint arm is pivoted at one end of the fixed arm and engages a cam on the pivoted arm. The pivoted arm is angled about the pivot point so as to provide a side load on the end pivoted arm so as to open the restraint arm when in the release position, freeing the cargo for a gravity air drop.

12 Claims, 2 Drawing Figures

CONTAINER RESTRAINT RELEASE

BACKGROUND OF THE INVENTION

This invention pertains to restraint/release mechanisms used in the air drop of military cargo from flying airplanes.

The current container delivery systems used to air drop cargo from flying airplanes employ plywood skidboards to which the cargo bundle is secured. The skidboard interfaces with a cargo roller system installed in the aircraft floor. The cargo airplane making the drop is put into a nose-up attitude as the aircraft approaches the drop point. The cargo restraint is released allowing the cargo load to roll out the open door and air drop to the ground. The restraint for the cargo containers in the aft direction is provided by a release gate constructed from Type XXVI nylon webbing. Presently, the release of the containers at the drop zone is accomplished by cutting the webbing at the proper point in the drop zone. A guillotine knife actuated by a cable suspended from the aircraft overhead structure and actuated by a cable winch is used to cut the webbing. At the drop point, the cable is reeled in, cutting the nylon webbing at the release gate which allows the containers to roll aft and out of the aircraft. The action is initiated by the co-pilot pressing a switch provided by an umbilical running to the retriever winch. The load master located in the cargo compartment stands at ready to put a downward force on the winch cable if the winch malfunctions.

The current system is awkward, inefficient, and sometimes hazardous. Feeding the winch cable to the guillotine strap cutter is time-consuming and awkward. The release process destroys the aft restraint as the webbing strap is cut into two pieces. Further, the entire load of containers must be dropped in two releases as only two winches exist. More than two releases necessitates a re-rigging between drops.

It is an important object of the present invention to replace the knife-actuated strap cutter of the current art with a release mechanism which may be either remotely operated or manually operated at the device, attaches to the floor, is easily installed, does not cut, rupture or fracture any part of the retention/release system, has no loose pieces and is reuseable as is, without the addition of any new parts.

SUMMARY OF THE INVENTION

In summary, the mechanism for retention and release of air-dropped cargo of this invention accomplishes the above objects and overcomes the disadvantages of the prior devices by providing a mechanism which is interposed between fixed structure and the webbing strap which, in turn, encompasses the cargo to be dropped. At the point of release, either on manual command or remote command, the cargo container mechanism is released for drop. The mechanism consists of a pair of arms oriented generally opposite each other, one of which is fixed to a frame and the other is pinned to the frame at a single point so as to permit rotation about the pivot point. Interposed between one set of ends of the two arms is a fulcrum rod which translates between two positions. In the first, or closed position, one end of the pivoted release arm bears against the fulcrum rod which prevents rotation about the pivot point of the release arm which prevents the release arm from rotating away from the fixed arm. In the second, or open position, the fulcrum rod does not bear against the end of the moving release arm and the arm is free to rotate so as to permit opening the distance between the end of the fixed arm remote from the fulcrum rod and the rotating release arm. The elements of the release arm are arranged so that when an axial tension load is applied to the arm, a side load is applied on the release arm tending to rotate the end of the arm remote from the fulcrum rod away from the fixed arm. Pivotally attached to the fixed arm at the end remote from the fulcrum is a restraint arm which terminates at the free end in a cam surface which bears against the end of the release arm so as to bridge between the two arms at the ends remote from the fulcrum and the cam end of the restraint arm bears against a suitable surface on the end of the release arm. The restraint arm remains in this bridged position as long as the fulcrum rod remains in the closed position and bears against the end of the release arm. The loop in the nylon webbing strap fits around the restraint arm so as to apply a trans-axial tension load. At the moment of release, the fulcrum rod is moved to the open position allowing the release arm to rotate about its pivot point, and since there is a side load imposed on the release arm, the release arm rotates so as to open the hinged, restraint arm and release the web strap. The attitude of the airplane and the forces of gravity control the drop at this point.

BRIEF DESCRIPTION OF THE DRAWINGS

With reference to the drawings, wherein like reference numerals designate like portions of the invention.

DESCRIPTION OF THE PREFERRED EMBODIMENT

Figures 1, 2:
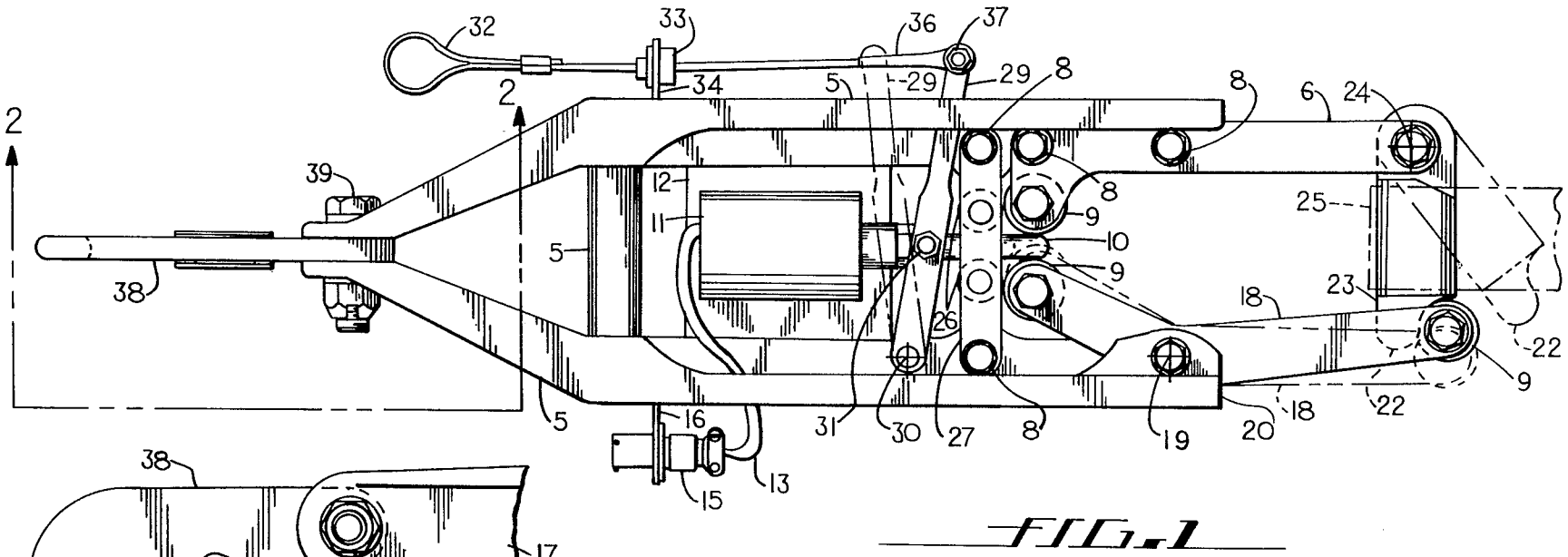
FIG. 1 is a plan view of the retainer/release mechanism shown in the closed position in the solid lines and in the open position in the phantom lines.
FIG. 2 is a partial side view showing a hook at one end of the structure.

FIG. 1 shows an overall view of the device which includes a frame 5 to which is bolted the fixed arm 6 with the bolts 8. Shown at 9 is a pair of rollers which support and bear against the fulcrum rod 10. The fulcrum rod 10, in turn, attaches to the solenoid 11 for remote actuation. The solenoid 11 is mounted to a plate 12 by fasteners (not shown) and the plate in turn is attached to the frame 5 by fasteners (also not shown). The electrical lead wires 13 from the solenoid are shown terminating in an electrical receptacle 15 which is in turn supported by an angle bracket 16 attached to the web 17 of the frame 5 with fasteners (not shown).

The fulcrum rod 10 is shown in the extended or closed position where it bears against the roller 9 attached to the release arm 18. The release arm 18 is shown pivotally connected at 19 to the clevis 20 which is shown as an integral part of the frame 5. The other end of the release arm 18 also terminates in a roller 9 and engages the cam surface 22 on the restraint arm 23 which in turn is pivotally attached to the fixed arm 6 at 24. A nylon webbing strap 25 is shown in reference lines terminating in a loop which envelopes the restraint arm 23. Here, in the preferred embodiment, the release arm 18 is shown as an angled arm pivoted at 19 so as to provide a side load at the end of the arm 18 when a tension load is applied to the strap 25, but further rotation of the arm 18 is prevented by the fulcrum rod 10. The side load is proportional to the axial load with the angled release arm which is important since, in the release position, the side force to open the release arm is a function of forces which vary with the axial load. However, this need not be an angled arm as this result can be accomplished in other ways by those skilled in the art.

Further support for the fulcrum rod 10 is provided by the smaller rollers 26, which are supported by a pair of straps 27 (only one of which is shown) and attached to the frame 5 by the bolts 8.

In addition to the solenoid 11, a manual operator 29 is provided shown pivoted at 30 and attached to the fulcrum rod 10 by the pin 31. The manual operator 29 is actuated by pulling on the lanyard 32 shown supported by the bushing 33 which is in turn supported by the bracket 34 attached to the web of frame 5 with fasteners (not shown). The lanyard 32 is shown terminating in a swaged clevis 36 and pinned with the fastener 37 to the manual operator 29.

Frame 5 is shown terminating in a hook 38 which is attached by the bolt and nut 39 which is provided to hook the mechanism to aircraft structure and particularly tiedown rings located in the cargo floor.

It should now be reasonably clear that the restraint-/release mechanism functions to restrain the cargo container by restraining the web strapping which in turn circumscribes the cargo container and, on command, either manually or remotely, the mechanism releases the cargo by releasing the web strap. The mechanism functions without cutting, rupturing or fracturing anything, has no loose parts and is immediately reuseable.

What is claimed is:

1. A retainer/release mechanism for air dropped cargo restrained by straps comprising:

a frame;

a fixed arm attached to said frame;

a release arm, having first and second ends, pivotally attached to said frame at a point intermediate said first and second ends and having a cam mating surface near said second end and oriented generally opposite and spaced from said fixed arm;

means to restrain and release said release arm;

a restraint arm, adapted to receive said strap, pivotally attached at one end of said fixed arm and having the free end terminating in a cam surface which engages said cam mating surface on said release arm when said release arm is restrained so as to bridge between said fixed arm and said release arm and not engage said cam mating surface when said release arm is released; and means to provide a side load on said second end of said release arm tending to rotate said second end of said release arm away from said fixed arm.

2. The retainer/release mechanism of claim 1 wherein the end of said frame opposite said restraint arm is provided with a hook for attachment restraint.

3. The retainer/release mechanism of claim 1 wherein said means to restrain and release said release arm is a fulcrum rod supported in said frame so as to permit axial translation between a closed position wherein said first end of said release arm engages said fulcrum rod so as to restrain said release arm and an open position wherein said first end of said release arm is unrestrained by said fulcrum rod and free to rotate about said pivot and release said restraint arm.

4. The retainer/release mechanism of claim 1 wherein said means to provide a side load on said second end of said release arm tending to rotate said second end of said release arm away from said fixed arm is directly proportional to the trans-axial tension load applied to said restraint arm.

5. The retainer/release mechanism of claim 3 further comprising a solenoid attached to said frame, wherein said fulcrum rod is attached to the armature of said solenoid and translates from the closed position to the open position by energizing said solenoid.

6. The retainer/release mechanism of claim 5 further comprising a linkage means attached to said frame and attached to said fulcrum rod so as to manually move said fulcrum rod whereby said retainer/release mechanism may be released either manually or remotely by energizing said solenoid.

7. The retainer/release mechanism of claim 3 wherein said means to provide a side load on said second end of said release arm is provided by angling said ends of said release arm about said pivot point so that an axial tension load applied at said second end of said release arm provides said side load tending to rotate said second end of said release arm away from said fixed arm.

8. A retainer/release mechanism for air drop of cargo, comprising:

a frame;

a fulcrum rod supported in said frame so as to permit axial translation between an open position and a closed position;

a fixed arm oriented generally parallel to the translation axis of said fulcrum rod and attached to said frame;

a release arm having first and second ends, pivotally attached to said frame at a point intermediate said first and second ends, and oriented generally opposite said fixed arm and having one end engage said fulcrum rod when said rod is in the closed position and not engage said rod when said rod is in the open position;

means to impose a side load at said second end of said release arm tending to rotate said second end away from said fixed arm when a generally axial tension load is applied to said release arm; and a restraint arm pivotally attached at one end of said fixed arm and having the free end terminating in a cam surface which engages said second end of said release arm so as to bridge between said fixed arm and said release arm when said fulcrum rod is in said closed position and said cam surface does not engage said second end of said release arm when said fulcrum rod is in said open position, all with the application of a generally axial tension load applied to said release arm.

9. The retainer/release mechanism of claim 8 wherein said means to provide a side load on said second end of said release arm tending to rotate said second end of said release arm away from said fixed arm is directly proportional to the trans-axial tension load applied to said restraint arm.

10. The retainer/release mechanism of claim 8 wherein said means to provide a side load on said second end of said release arm is provided by angling said ends of said release arm about said pivot point so that an axial tension load applied at said second end of said release arm provides said side load tending to rotate said second end of said release arm away from said fixed arm.

11. The retainer/release mechanism of claim 10 further comprising a solenoid attached to said frame, Wherein said fulcrum rod is attached to the armature of said solenoid and translates from the closed position to the open position by energizing said solenoid.

12. The retainer/release mechanism of claim 11 further comprising a linkage means attached to said frame and attached to said fulcrum rod so as to manually move said fulcrum rod whereby said retainer/release mechanism may be released either manually or remotely by energizing said solenoid.

* * * * *